US009151030B2

(12) United States Patent
Siena et al.

(10) Patent No.: US 9,151,030 B2
(45) Date of Patent: Oct. 6, 2015

(54) UNIVERSAL TOILET LEVER

(75) Inventors: Matthew J Siena, Portland, CT (US); John H Siena, Portland, CT (US); Chris W Jeffers, Hebron, CT (US)

(73) Assignee: The Keeney Manufacturing Company, Newington, CT (US)

( * ) Notice: Subject to any disclaimer, the term of this patent is extended or adjusted under 35 U.S.C. 154(b) by 2659 days.

(21) Appl. No.: 11/602,548

(22) Filed: Nov. 21, 2006

(65) Prior Publication Data

US 2008/0115263 A1 May 22, 2008

(51) Int. Cl.
*E03D 5/00* (2006.01)
*E03D 5/02* (2006.01)
*E03D 5/094* (2006.01)

(52) U.S. Cl.
CPC . *E03D 5/02* (2013.01); *E03D 5/094* (2013.01)

(58) Field of Classification Search
CPC ..... E03D 5/09; E03D 5/094
USPC ..... 4/405, 411–414
See application file for complete search history.

(56) References Cited

U.S. PATENT DOCUMENTS

| | | | | | |
|---|---|---|---|---|---|
| 361,203 | A * | 4/1887 | Bate | 4/411 |
| 4,141,092 | A * | 2/1979 | Jones | 4/324 |
| 4,173,044 | A * | 11/1979 | Ota | 4/325 |
| 4,391,003 | A * | 7/1983 | Talerico et al. | 4/415 |
| 5,067,180 | A * | 11/1991 | Figeroid | 4/326 |
| 6,178,567 | B1 * | 1/2001 | Bliss | 4/405 |
| 6,453,480 | B1 * | 9/2002 | Yeh | 4/405 |
| 7,120,944 | B2 * | 10/2006 | Dorsher | 4/405 |

* cited by examiner

*Primary Examiner* — Tuan N Nguyen
(74) *Attorney, Agent, or Firm* — Alix, Yale & Ristas, LLP

(57) ABSTRACT

A universal kit for installing a flush lever (22) on a toilet water tank wall (12A), and a toilet with the kit components installed therein, whereby the same components can be used to quickly and efficiently install the handle on the front face, side face, or angled portion of the toilet tank. The kit comprises a fixture (66) for mounting a flush rod actuation handle (20) on a tank wall, whereby the handle can be rotated about an axis (58, 60) extending perpendicularly from the wall into the tank. A flush rod (34) is angulated in three dimensions and has opposite end portions (36, 38), having the same shape, such that either end portion is selectively securable in the mounting fixture (66) for corotation with the handle.

19 Claims, 7 Drawing Sheets

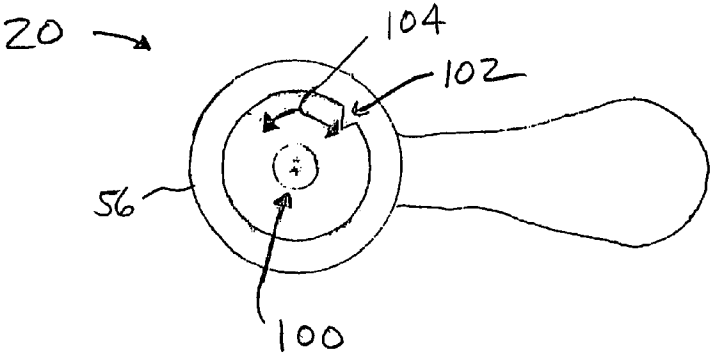
FIGURE 10
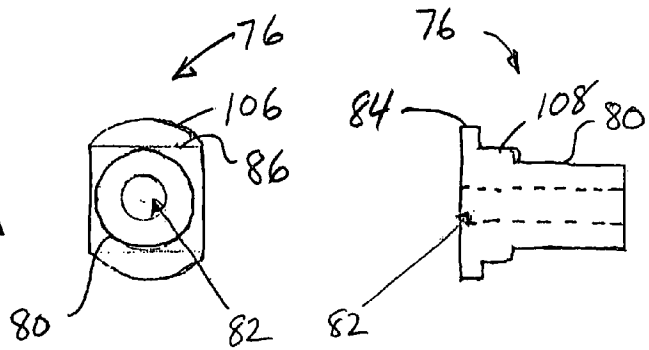
FIGURE 11A
FIGURE 11B

UNIVERSAL TOILET LEVER

BACKGROUND OF THE INVENTION

The present invention relates to bathroom fixtures, and particularly, to the flush lever associated with toilets.

Both consumer and institutional toilets can be ordered in a wide variety of sizes, styles, and colors. Regardless of this wide variety of available options, most toilets are operated by a handle located on either the front face or the side face of the water tank that rises from behind the seat. In some toilet installations the handle is on at an angled portion of the tank at the transition from the front face to the side face. Rotation of the handle produces a levered rotation of the flush rod located in the tank, which in turn lifts a chain associated with the flapper or other flushing mechanism to release water from the tank into the bowl.

The purpose of the present is to provide a kit, and a toilet with the kit components installed therein, whereby the same components can be used to quickly and efficiently install the handle on the front face, side face, or angled portion of the toilet tank.

SUMMARY OF THE INVENTION

According to one aspect associated with the invention, a universal kit for installing a flush lever on a water tank comprises a fixture for mounting a flush rod actuation handle on the tank. A flush rod angulated in three dimensions has opposite ends, either of which can be selectively securable in the mounting fixture for co-rotation with the handle about an axis extending perpendicularly into the tank.

Preferably, the flush rod has a first flat end portion, and a second flat end portion lying substantially on a plane that is perpendicular to the first end portion, and an intermediate portion that is angulated relative to the end portions. Each of the end portions has holes for selective attachment of the flush valve chain. The tank mounting assembly includes a shaft connected to and rotatable with the handle. The shaft has a slot for receiving and securing either flat end portion of the flush rod. When one end of the flush rod is secured with the handle at the front face of the tank, rotation of the handle causes the other end of the rod, to which the chain is attachable, to rise and fall in a plane parallel to the front face of the tank. When the other end of the flush rod is secured with the handle at a side face of the tank, the opposite end of the flush rod rises and falls in a plane that is parallel to the side face of the tank.

As assembled on a wall of a toilet tank for rotation about an axis extending into the tank, the invention preferably comprises a mounting assembly engaging a mounting hole in the tank wall and having a shaft passing through the tank wall and rotatable about the axis. The handle outside the tank is operatively connected to one end of the shaft, for rotating the shaft. The flush rod has one end secured in a fitting at the other end of the shaft, and angulated in three dimensions within the tank to another end that is co-rotatable with the handle about the axis. Each of the flush rod ends has substantially the same size and shape such that either end portion is selectively securable in the shaft fitting.

Those familiar with this field will recognize that such universal kit can reduce the inventory and space occupied by parts in a van or the like of the professional plumber, and the same benefit is likewise realized by a retailer or wholesaler of plumbing supplies. Moreover, at the retail level, an end-user can avoid the mistake of purchasing a kit for side installation, when the purchaser's toilet is designed for front installation, or visa versa.

As will be more fully appreciated from the description set forth below, the mounting assembly into which either end of the flush rod can be inserted and secured, is preferable of a straight forward, simple configuration that does not require adjustment or modification depending on which end of the flush rod is installed, and likewise, no modification is required on either end of the flush rod prior to installation into the mounting assembly for front or side mounting. A simple bending of the flush rod is required for installation on an angled surface of the tank.

BRIEF DESCRIPTION OF THE DRAWING

The preferred embodiment will be described with reference to the accompanying drawing, in which:

FIG. 10 shows the substantially circular pedestal portion of the handle that engages the mounting assembly at the tank wall;

FIGS. 11*a* and 11*b* shows front and side views, respectively, of a spud that is specially adapted to cooperate with the handle shown in FIG. 10 in the mounting configuration as substantially shown in FIG. 8.

DESCRIPTION OF THE PREFERRED EMBODIMENT

Figure 1A:
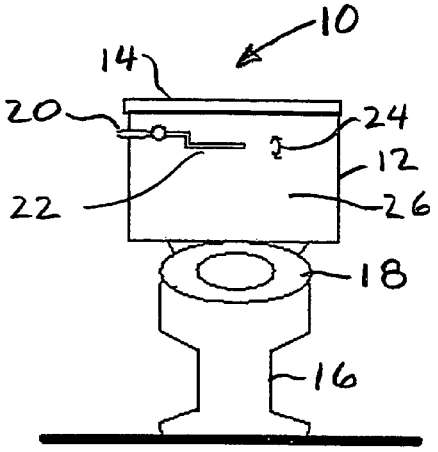
FIG. 1A is a schematic representation of the front of a typical toilet having a flush lever handle at the front face of the tank.

FIG. 1A shows a typical consumer or institutional toilet 10 as seen from the front, having an upright water tank 12 with removable cap 14, a bowl structure 16 that is secured to a floor, and a hinged seat 18. The toilet is flushed by the user's rotating handle 20, which causes a flush rod (shown in phantom at 22) within the tank, to rotate up or down, as indicated at arrow 24, in a plane substantially parallel to the front face 26 of the tank. As is well known, a chain attached to the free end of the flush rod is also attached to a flush mechanism (not shown), which is lifted from an opening at the bottom of the tank, to deliver water to the bowl 16.

Figure 1B:
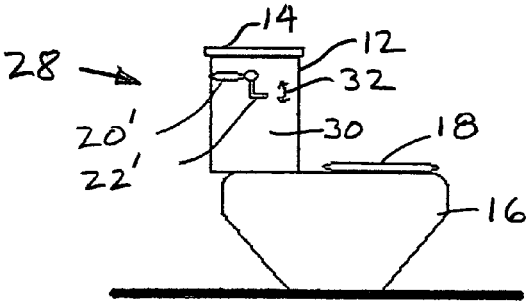
FIG. 1B is a schematic representation of a typical toilet, from the side, having a flush lever handle mounted in the side face of the tank.

FIG. 1B is a side view 28 of an alternative toilet tank, which is structurally similar to the tank of FIG. 1A with respect to the configuration of the tank 12, cap 14, bowl 16, and seat 18, except that the flush handle 20' is located on the side face 30 of the tank such that the other end of the flush rod 22' rotates 32 in a plane that is parallel to the side face 30.

Figure 2:
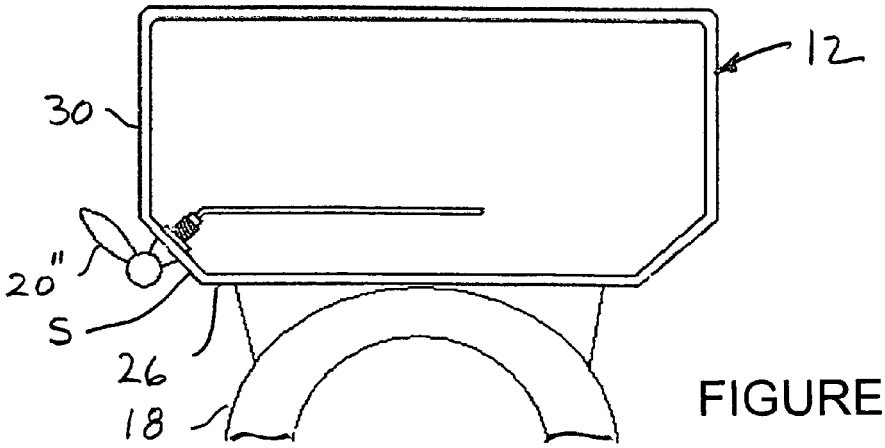
FIG. 2 is a schematic cross section view of a toilet tank, having a flush lever handle at an angled portion of the tank.

FIG. 2 shows a different shape of tank, wherein the transition from the front face 26 to side face 30 is not rounded or square, but instead presents a flat surfaces, resembling a panel, oriented at an angle to the front and side faces. The flush handle 20" penetrates the flat surface perpendicularly, but the rotation axis is typically at an angle in the range of about 25 to 45 degrees relative to the front face of the tank.

Figure 3:
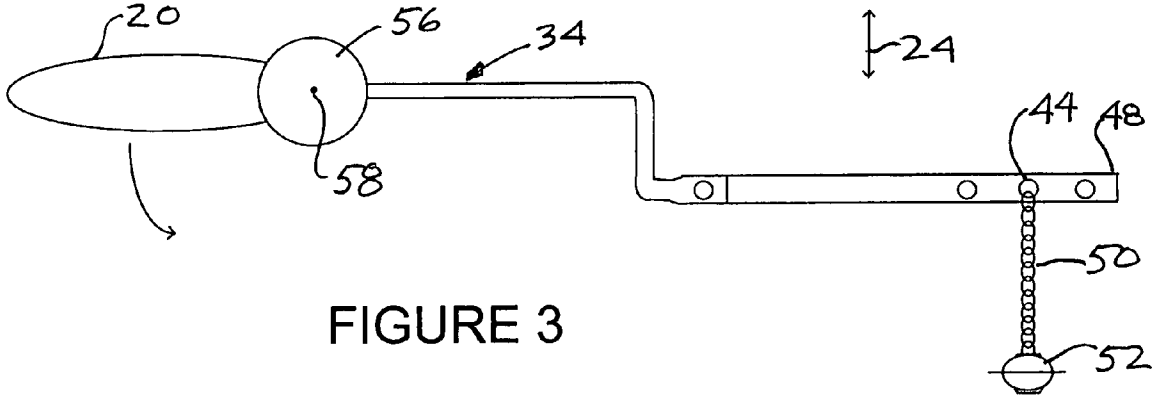
FIG. 3 is a view of the flush lever assembly handle and associated flush rod as mounted on the front of the tank, viewed in a direction from the front of the tank.
Figure 4:
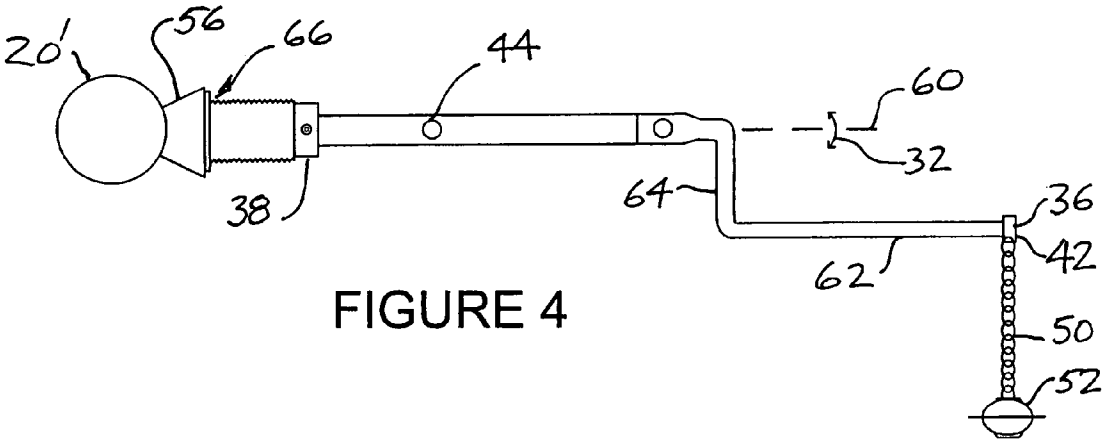
FIG. 4 is a view of the alternative flush lever assembly as mounted in the side face of the tank, viewed in a direction from the front of the tank.
Figure 5:
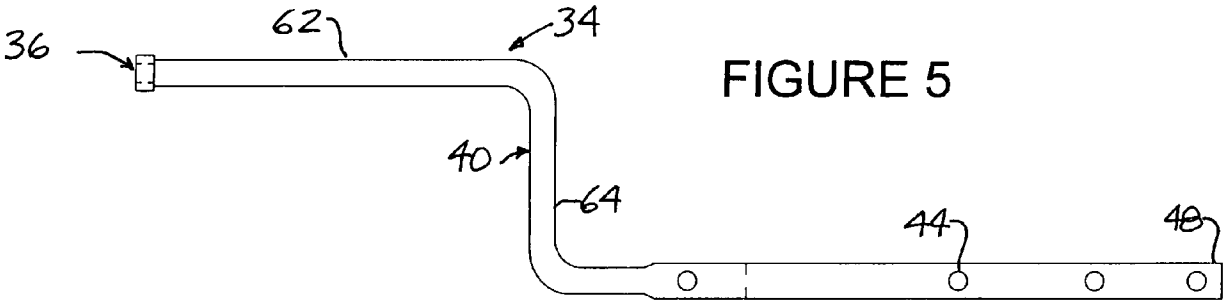
FIG. 5 is a view of the flush rod of FIG. 3, without the handle attached.
Figure 6:
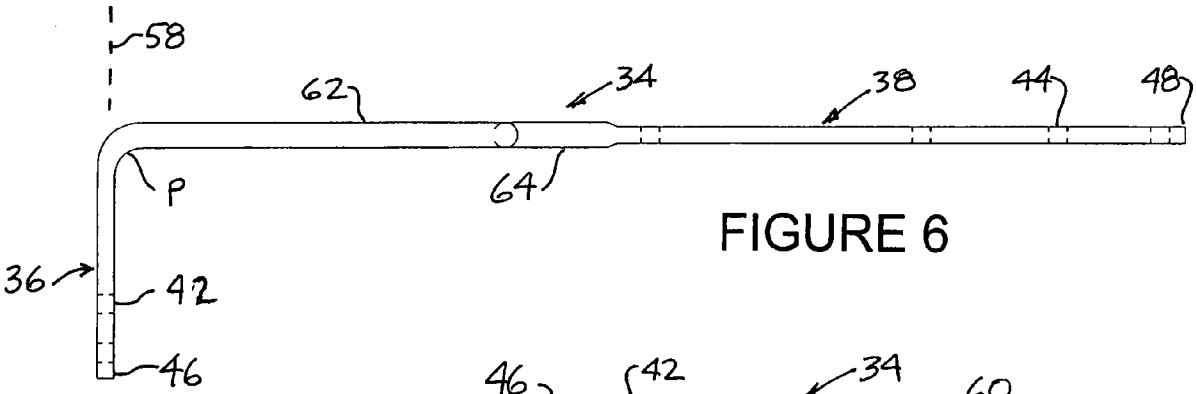
FIG. 6 is a top view of the flush rod of FIG. 5.

FIGS. 3-7 show the preferred form of the lever assembly, associated with flush rod 34. FIG. 3 shows the flush rod as would be mounted according to FIG. 1 and FIG. 5 shows the flush rod before attachment to the handle 20 and associated mounting structure. FIG. 6 is a top view of the flush rod as depicted in FIG. 5. The flush rod 34 has a first flat end portion 36 lying substantially on one plane, a second flat end portion 38 lying substantially on another plane that is perpendicular to the one plane, and an intermediate portion 40 that is angulated relative to the end portions. Each end portion has a plurality of holes 42, 44 for selective attachment of flush valve chain 50. The intermediate portion 40 of the flush rod is preferable substantially L-shaped, with legs 62, 64. The intermediate portion lies in substantially the same plane as the second flat end portion 38. The second end portion 38 preferably extends perpendicularly to but in the same plane as one leg 64 of the intermediate portion. The first flat end portion 36 preferably extends perpendicularly in a transverse plane relative to the other leg 62 of the intermediate portion.

In FIG. 3, the flush valve chain 50 and associated flush valve 52 depend from the middle of three indicated holes 44, but the chain 50 can be secured to any one of the holes, depending on the dimensions of the tank. Optionally, the end portion can be adapted for clean break off of excess length. It is also preferable that the intermediate portion 40 has a round cross section, to improve strength given the relatively long lever arm as compared with the length of handle 20 for rotation about axis 58, which passes through the flange or pedestal portion 56 of the handle. It should be appreciated that end portion 36 is inserted, with leading tip 46, into the base associated with the handle flange 56, in a direction along rotation axis 58, when the handle is attached to the front face of the tank as depicted in FIG. 1.

Figure 7:
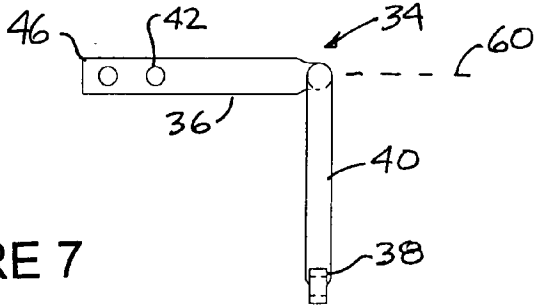
FIG. 7 is an end view of the flush rod of FIG. 6, as observed from the right.

With reference now to FIGS. 4 and 7, the other end 38 of the flush rod is inserted with leading tip 48, into the base 66 and associated handle pedestal 56 for rotation of the flat end portion 36, about axis 60, thereby lifting the flush valve 52 (i.e., flapper or other flushing mechanism) via chain 50 attached to a hole 42 in flat end portion 36.

It can be appreciated from FIG. 3 that the lever arm length for the front face attachment to the tank, extends from rotation axis 58 to the point of attachment of chain 50, in the plane of the drawing. This length would, for typical installations, be on the order of 6-12 inches. Considerable leverage is obtained, even when the handle is rotated only about two inches over a rotation angle of about 45 degrees, in that end of the chain is lifted via opposite end portion by 4-6 inches. Preferable, the end portion 36 is between 1½ and 2 inches long, most preferable 1¾ inches long, whereas the overall length of the rod as shown in FIG. 5 is preferable about 8 inches.

In the case of the alternative shown in FIG. 4, for mounting on the side face of the tank, the lever arm length is the sum of the length of the leg portion 64 and the length of the end portion 36 from the connection or bend at leg portion 62 out to the particular hole 42 through which the chain is connected. Thus it can be appreciated that with either alternative, substantial leverage is available for operating the flush valve.

The flush rod assembly can readily be mounted in the angled tank wall as shown in FIG. 2. With reference also to FIG. 6, the rod as oriented for mounting in the front face configuration, can be bent at point P, thereby setting the rod substantially parallel to the front face of the tank. Point P can be a weakened region between the first end portion 36 and the intermediate portion 40, to facilitate manual bending during installation. Although the rod will not remain exactly parallel to the front face of the tank as the handle 20" is rotated, such deviation is relatively small in comparison with the available lift displacement the rotating rod can impart to the flush mechanism.

Figure 8:
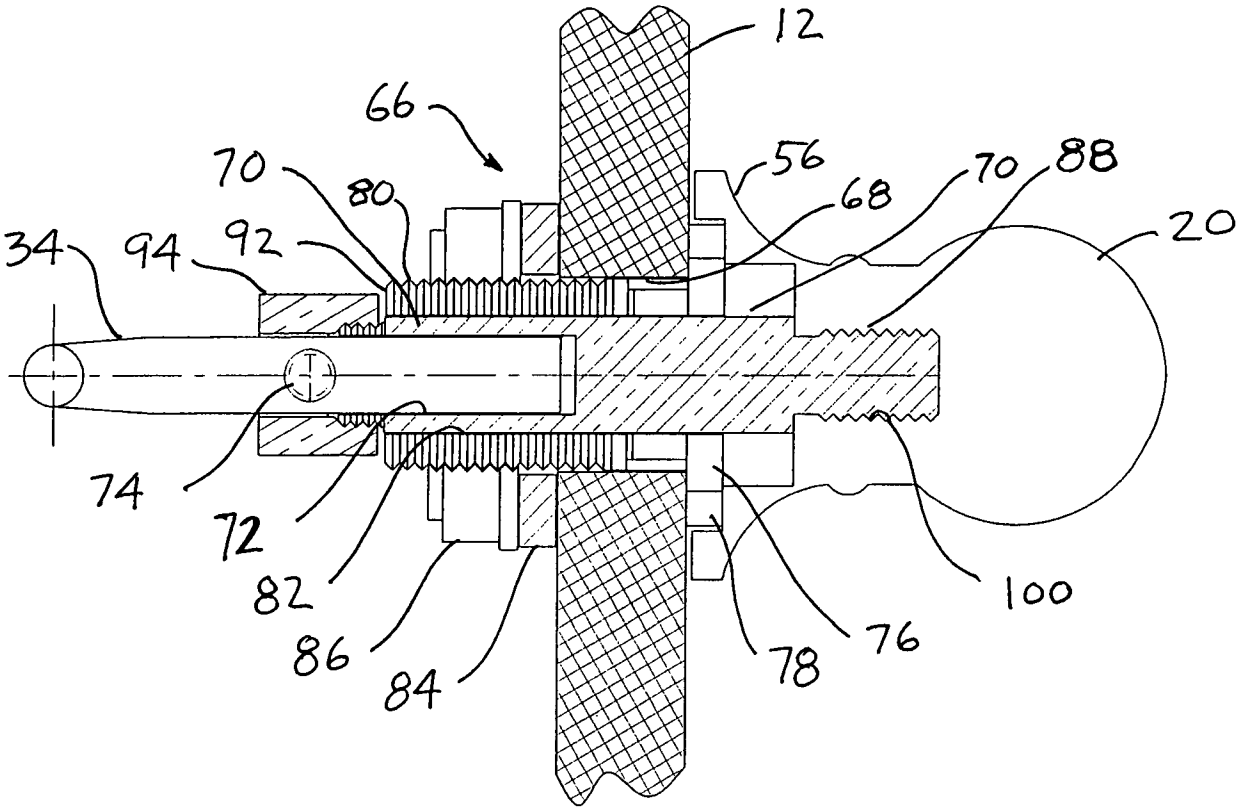
FIG. 8 is a schematic longitudinal section view of one end of the flush rod secured to a mounting assembly on a wall of the toilet tank.
Figure 9A:
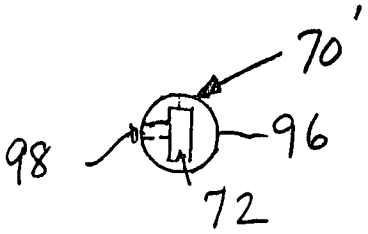
FIG. 9*a* is an end view of the shaft portion of the mounting assembly, as viewed from the left in FIG. 8, in an alternative embodiment to that shown in FIG. 8, illustrating the slot for receiving either end of the flush rod and a set screw for securing the flush rod in the slot.

FIG. 8 shows one mounting configuration between the flush rod 34 and the handle 20 at the tank wall 12. FIGS. 10 and 11 may be considered in conjunction with FIG. 8, whereas FIGS. 9*a* and *b* show an alternative implementation of one component depicted in FIG. 8.

The base assembly 66 connects the handle 20 with the flush rod 34 through opening 68 in the tank wall 12. The tank mounting assembly comprises base 66, shaft 70 rotatably supported in the base, and the handle 20 operatively securable to one end of the shaft. The shaft 70 has a slot 72 at the other end for receiving either flat end 36, 38 of the flush rod 34. Preferable, means, such as a setscrew 74 or the like, secure the flush rod within the shaft.

The base 66 comprises a spud 76 having one end 78 engageable with the flange portion 56 of the handle 20, an elongated externally threaded shank 80, and a central through bore 82 for receiving the shaft 70. A rubber washer is preferable fitted over the shank, against the tank wall 12. A spud lock nut 86 is threadably advanced along the shank, against the washer 84. Preferably, the shaft 70 comprises an externally threaded front end 88 engageable with the handle 20, and a cylindrical body portion 90 sized to fit within the throughbore 82 of the spud 76. The slot 72 extends from a back end 92 of the shaft into the body portion 90. In the embodiment shown in FIG. 8, a shaft lock nut 94 threadably engages a threaded tip extending from the shaft, and carries the set screw 74 passing through the shaft lock nut for bearing against the flat end portion of the flush rod when received in the shaft.

Figure 9B:
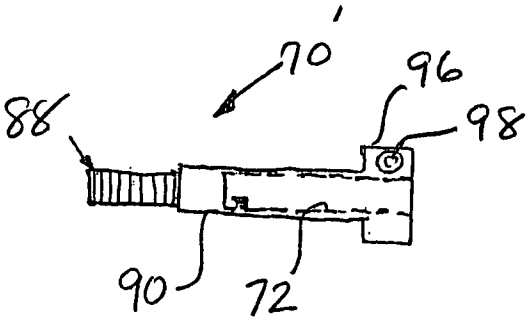
FIG. 9*b* is a longitudinal view of the shaft of FIG. 9*a*, with the left portion adapted to threadably engage the handle and the right portion adapted to receive either end of the flush rod.

An alternative arrangement is shown in FIG. 9, where the shaft 70' has an integral flange or the like 96 with associated set screw 98 penetrating into the slot 72 which receives the end of the flush rod.

FIGS. 10 and 11 provide additional details on the relationship between the flange or pedestal portion 56 of the handle 20 and the spud 76. The central hole 100 is drilled and tapped with left hand threads for receiving the threaded portions 78 of the shaft (see FIG. 8). The annulus around the hole 100 is filled and notched 102 to accommodate the threaded spud and the movement 104 of the threaded spud between the stop notch 102. The spud 76 has hole 82 (see FIG. 8) for receiving the shaft, and is surrounded by threaded tubular portion 80. The threads 80 on the spud are left handed, per standard threaded spuds. The surface 106 interacts with the stop 102 and also serves to hold the assembly against the outside of the toilet tank in conjunction with lock nut 86. The square section

108 of the spud is inserted into the square cut out in the toilet tank that keeps the entire assembly from rotating when the handle is operated.

Figure 12:
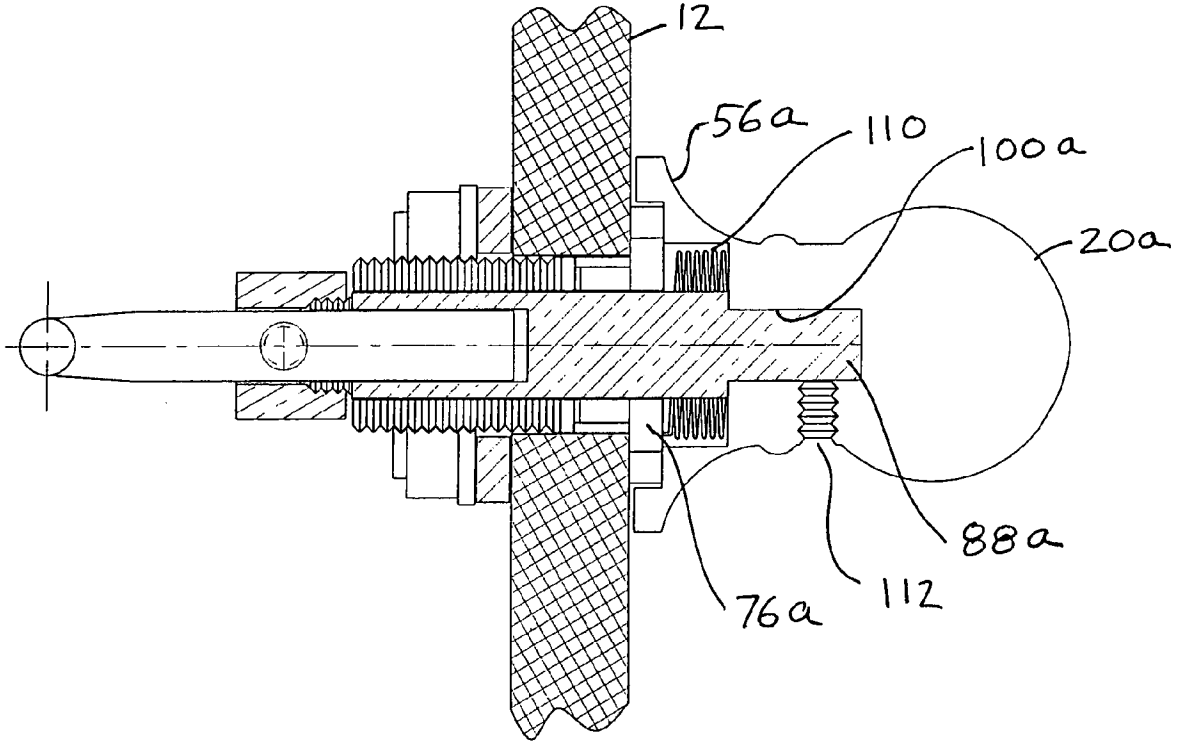
FIG. 12 is schematic longitudinal section view of an alternative configuration for securing one end of the flush rod to a mounting assembly on a wall of the toilet tank.

FIG. 12 shows an alternative mounting configuration that is more adaptable to different size openings in the toilet tank, relative to that shown in FIG. 8. One difference is in the spud 76*a*, where a coil spring 110 or similar rotational biasing means interacts between the spud 76*a* and the handle base 56*a* so that the lever will return to the proper rest position after flushing. Another difference is that the central hole 100*a* in the handle is not tapped, and portion 88*a* of the shaft 8 is not threaded. Instead, a pin-style connection with a setscrew 112 threaded through the handle 20*a* secures the shaft portion 88*a*.

The invention claimed is:

1. A universal kit for installing a flush lever on a toilet water tank, comprising:

(i) a flush rod having a first flat end portion lying substantially on one plane, a second flat end portion lying substantially on a plane that is perpendicular to said one plane, and an intermediate portion that is angulated relative to the end portions, each of said end portions having a plurality of holes therein for selective attachment of a flush valve chain;

(ii) a tank mounting assembly having a base for engaging a mounting hole in the tank, a shaft rotatably supported in the base, and a handle operably securable to one end of the shaft;

(iii) said shaft having a slot at the other end for receiving either flat end portion of the flush rod; and (iv) means for fixing the rod in place in said slot.

2. The kit of claim 1, wherein the intermediate portion of the flush rod is substantially L shaped, and lies in substantially the same plane as said second flat end portion.

3. The kit of claim 2, wherein the second end portion extends perpendicularly to but in the same plane as one leg of the L shaped intermediate portion, and the first flat end portion extends perpendicularly in a transverse plane relative to the other leg of the intermediate portion.

4. The kit of claim 2, wherein said intermediate portion has a round cross section.

5. The kit of claim 1, wherein the base comprises:

(i) a spud having one end engageable with the handle, an elongated, externally threaded shank, and a central throughbore for receiving the shaft;

(ii) a washer sized to pass over the shank; and (iii) a spud locknut for advancing along the shank against the washer.

6. The kit of claim 5, wherein the shaft comprises:

(i) an externally threaded front end engageable with the handle; and (ii) a cylindrical body portion sized to fit within the throughbore of the spud;

(iii) wherein said slot extends from a back end of the shaft into said body portion.

7. The kit of claim 6, wherein the means for fixing the rod in place in said slot includes means engageable with the back end of the shaft, for selectively fixing either flat end portion of the flush rod when situated in said slot.

8. The kit of claim 7, wherein the shaft back end is threaded and the means engageable with the back end includes a shaft lock nut and a set screw passing through the shaft lock nut for bearing against the flat end portion the of flush rod when received in the shaft.

9. The kit of claim 5, wherein the shaft comprises:

(i) a front end penetrating a bore in the handle and secured in the handle by a setscrew; and (ii) a cylindrical body portion sized to fit within the throughbore of the spud;

wherein said slot extends from a back end of the shaft into said body portion.

10. The kit of claim 5, including means situated between the spud and the handle, for rotationally biasing the handle toward a rest position.

11. The kit of claim 1, wherein a weakened region to facilitate manual bending is provided between the first end portion and the intermediate portion.

12. A universal kit for installing a flush lever on a toilet water tank wall, comprising:

a fixture for mounting a flush rod actuation handle on a tank wall, for rotation of the handle about an axis extending perpendicularly from the wall into the tank; and a flush rod angulated in three dimensions and having opposite end portions, each end portion selectively securable in said mounting fixture for corotation with the handle about said axis.

13. The kit of claim 12, wherein the flush rod has a first flat end portion lying substantially on one plane, a second flat end portion lying substantially on a plane that is perpendicular to said one plane, and an intermediate portion that is angulated relative to the end portions, each of said end portions having a plurality of holes therein for selective attachment of a flush valve chain whereby when one of either end is selected for securement in a mounting fixture the opposite end is adapted for attachment of a flush valve chain in a selected hole.

14. The kit of claim 13, wherein the intermediate portion of the flush rod is substantially L shaped, and lies in substantially the same plane as said second flat end portion.

15. The kit of claim 14, wherein the second end portion extends perpendicularly to but in the same plane as one leg of the L shaped intermediate portion, and the first flat end portion extends perpendicularly in a transverse plane relative to the other leg of the intermediate portion.

16. A flush rod assembly mounted on a wall of a toilet tank for rotation about an axis extending into the tank, comprising a mounting assembly engaging a mounting hole in the tank wall and having a shaft passing through the tank wall and rotatable about said axis;

a handle outside the tank and operatively connected to one end of the shaft, for rotating said shaft;

a flush rod having one end secured in a fitting at the other end of the shaft, and angulated in three dimensions within the tank to another end that is corotatable with said handle about said axis, each of said flush rod ends having substantially the same size and shape such that either end portion is selectively securable in said shaft fitting, said flush rod further including a plurality of spaced apart holes at each end; and a flush valve chain attached to a hole at said other end.

17. The assembly of claim 16, wherein the flush rod first end portion is flat and lies substantially on one plane, the other end portion is flat and lies substantially on a plane that is perpendicular to said one plane, and an intermediate portion is angulated relative to the end portions, each of said end portions having a plurality of holes therein for selective attachment of a flush valve chain.

18. The assembly of claim 17, wherein the intermediate portion of the flush rod is substantially L shaped, and lies in substantially the same plane as said second end portion.

19. The assembly of claim 18, wherein the second end portion extends perpendicularly to but in the same plane as one leg of the L shaped intermediate portion, and the first flat end portion extends perpendicularly in a transverse plane relative to the other leg of the intermediate portion.

* * * * *